US005513980A

United States Patent [19]

Rasmussen et al.

[11] Patent Number: 5,513,980

[45] Date of Patent: May 7, 1996

[54] METHOD AND APPARATUS TO OVERRIDE THE CHILD-RESISTANT MECHANISM OF DISPOSABLE LIGHTERS

[76] Inventors: Clair L. Rasmussen, 1027 N. Main St.; Eldon L. Wheeler, 1246 Saddleback Dr., both of Cottonwood, Ariz. 86326

[21] Appl. No.: 397,957

[22] Filed: Mar. 3, 1995

[51] Int. Cl.[6] ..... F23D 11/36

[52] U.S. Cl. ..... 431/153

[58] Field of Search ..... 431/153

[56] References Cited

U.S. PATENT DOCUMENTS 3,936,746 5/1989 Schaefer .
4,799,877 1/1989 Bisbee ..... 431/153
5,002,482 3/1991 Fairbanks et al. .
5,076,783 12/1991 Fremund .
5,368,473 11/1994 Kenjiro et al. ..... 431/153

*Primary Examiner*—Carroll B. Dority
*Attorney, Agent, or Firm*—Benman Collins & Sawyer

[57] ABSTRACT

An apparatus and method are provided which override the child-resistant features implemented on disposable lighters in the form of locking mechanisms that restrict the movement of the thumb lever. More specifically, in the practice of the invention, a band having a laterally extending projection or, alternatively, a slot, is slid onto the lighter body until the laterally extending projection or slot aligns with the locking mechanism of the lighter. The laterally extending projection or slot disengages the locking mechanism by moving it out of the path of the thumb lever so that the thumb lever may be depressed at will. Thus, the apparatus and method of the invention enable disposable lighters to be operated as if no child-resistant features are present.

20 Claims, 3 Drawing Sheets

10
12
14
16
18
20
22
24
26
28
30
32
33
34

METHOD AND APPARATUS TO OVERRIDE THE CHILD-RESISTANT MECHANISM OF DISPOSABLE LIGHTERS

BACKGROUND OF THE INVENTION

1. Field of the Invention

The present invention is related generally to disposable lighters, and more particularly, to overriding the child-resistant mechanism of disposable lighters.

2. Description of Related Art

All disposable and novelty lighters manufactured or imported into the United States after Jul. 12, 1994 are required to be "child-resistant" according to a federal regulation entitled "Safety Standard for Cigarette Lighters" found in 16 C.F.R. § 1210 (1994). The regulation provides that a lighter is "child-resistant" if at least 85% of the children in test surveys are unable to successfully operate the lighter (16 C.F.R. § 1210.3(a)). The regulation does not, however, mandate a particular method of compliance. Rather, the regulation simply notes that the child-resistant standard would likely be achieved "by modifying products to incorporate additional-action switches, levers, or buttons" to increase the difficulty of activating the lighter (16 C.F.R. § 1210.5(c)).

Accordingly, major manufacturers of disposable lighters have complied with this federal standard by providing lighters with locking mechanisms that prevent the depression of the thumb lever that operates the gas-releasing valve until a particular sequence of steps is performed. Mastering the sequence of steps required to disengage the locking mechanism is a challenge to young children, thereby rendering such disposable lighters "child-resistant". Moreover, the locking mechanism automatically re-engages once the thumb lever has been depressed.

The sequence of steps employed by major manufacturers to disengage the locking mechanism varies. For example, the Bic Corporation and the Scripto-Tokai Corporation, which respectively manufacture disposable Bic® and Scripto® lighters, employ a tab which must be pushed in and up before a flame may be produced by performing the familiar two-step motion of rotating the sparkwheel and releasing butane by depressing the thumb lever (see, respectively, U.S. Pat. No. 5,002,482 entitled "Selectively Actuatable Lighter" and U.S. Pat. No. 5,368,473 entitled "Gas Lighter with Safety Device"). Cricket U.S.A. and B.V. Poppell Netherlands, which respectively manufacture Cricket® disposable lighters and Poppell® disposable lighters, provide a button which must be pushed in before a flame may be produced by pressing down on the ignition lever. In contrast to the above designs which require a button or tab to be pushed in, disposable SAF-T-LOC™ lighters manufactured by Calico Brands are provided with a lever which must be moved to the left and up before a flame may be conventionally produced by rotating the sparkwheel and depressing the thumb lever.

While preventing children from operating disposable lighters is certainly worthwhile, the child-resistant features of disposable lighters make the operation of such lighters needlessly inconvenient in circumstances where children are never present, such as certain office settings. Moreover, certain groups of adults having afflictions such as arthritis and vision impairments may be physically unable to activate small buttons, tabs, and levers, but may be fully capable of performing the continuous motion of running their thumbs across the sparkwheel to depress the thumb lever. In such cases as an elderly person living alone and suffering from a debilitating illness such as arthritis, the burdens deriving from the child-resistant features of disposable lighters outweigh the benefits.

Thus, a need exists for a method and apparatus by which the child-resistant locking mechanism on disposable lighters may be temporarily overridden. The method and apparatus must be cost-effective, easily manufactured, non-intrusive, reversible, and adaptable for use with various conventional lighters.

SUMMARY OF THE INVENTION

The method and apparatus of the present invention serve to override the child-resistant features implemented on disposable lighters, so that the lighters may be operated as if no child-resistant features are present. More specifically, in the practice of the invention, a band having a laterally extending projection is slid onto the lighter body until the laterally extending projection aligns with the locking mechanism of the lighter. The laterally extending projection disengages the locking mechanism by moving it out of the path of the thumb lever so that the thumb lever may be depressed at will. In an alternative embodiment, a slot formed in the band is aligned with the locking mechanism and disengages the locking mechanism by blocking its return to a locked position.

Thus, the apparatus of the invention is easily implemented by simply positioning the band onto the lighter body such that the laterally extending projection (or alternatively, the slot) physically disengages the locking mechanism constituting the child-resistant feature of the lighter. So long as the band remains in place, the lighter may be operated as if the child-resistant feature did not exist.

While the band is a removable device that may be re-used, it will likely be considered disposable because of its low purchase price. In the preferred embodiment, the band is made of a plastic material by any of the known processes to shape such material, such as injection molding. While the apparatus of the invention may assume the shape of a band, it is preferably fashioned as a sleeve that encloses the entire body of the lighter below the lighter head.

The present invention enables those adults who use disposable lighters outside of the presence of children to bypass the sequence of steps normally required to operate commercially-available lighters with child-resistant features. For adults who are physically unable to perform the sequence of steps necessary to operate child-resistant lighters, the apparatus of the present invention restores to them the option of using disposable lighters.

In sum, the apparatus and method of the invention provide a low-cost, easily implemented, reversible, and non-intrusive manner in which to override the child-resistant mechanisms incorporated into disposable lighters.

BRIEF DESCRIPTION OF THE DRAWINGS

FIG. 1AA is a cut-away of the top portion of the disposable lighter portrayed in FIG. 1A showing the child-resistant feature of the lighter as it appears when disengaged.

FIG. 1BB is a cut-away of the top portion of the disposable lighter portrayed in FIG. 1B showing the child-resistant feature of the lighter as it appears when disengaged.

FIG. 1CC is a cut-away of the top portion of the disposable lighter portrayed in FIG. 1C showing the child-resistant feature of the lighter as it appears when disengaged.

FIG. 1DD is a cut-away of the top portion of the disposable lighter portrayed in FIG. 1D showing the child-resistant feature of the lighter as it appears when disengaged.

DESCRIPTION OF THE PREFERRED EMBODIMENTS

Figures 5, 6, 6A, 7, 8:
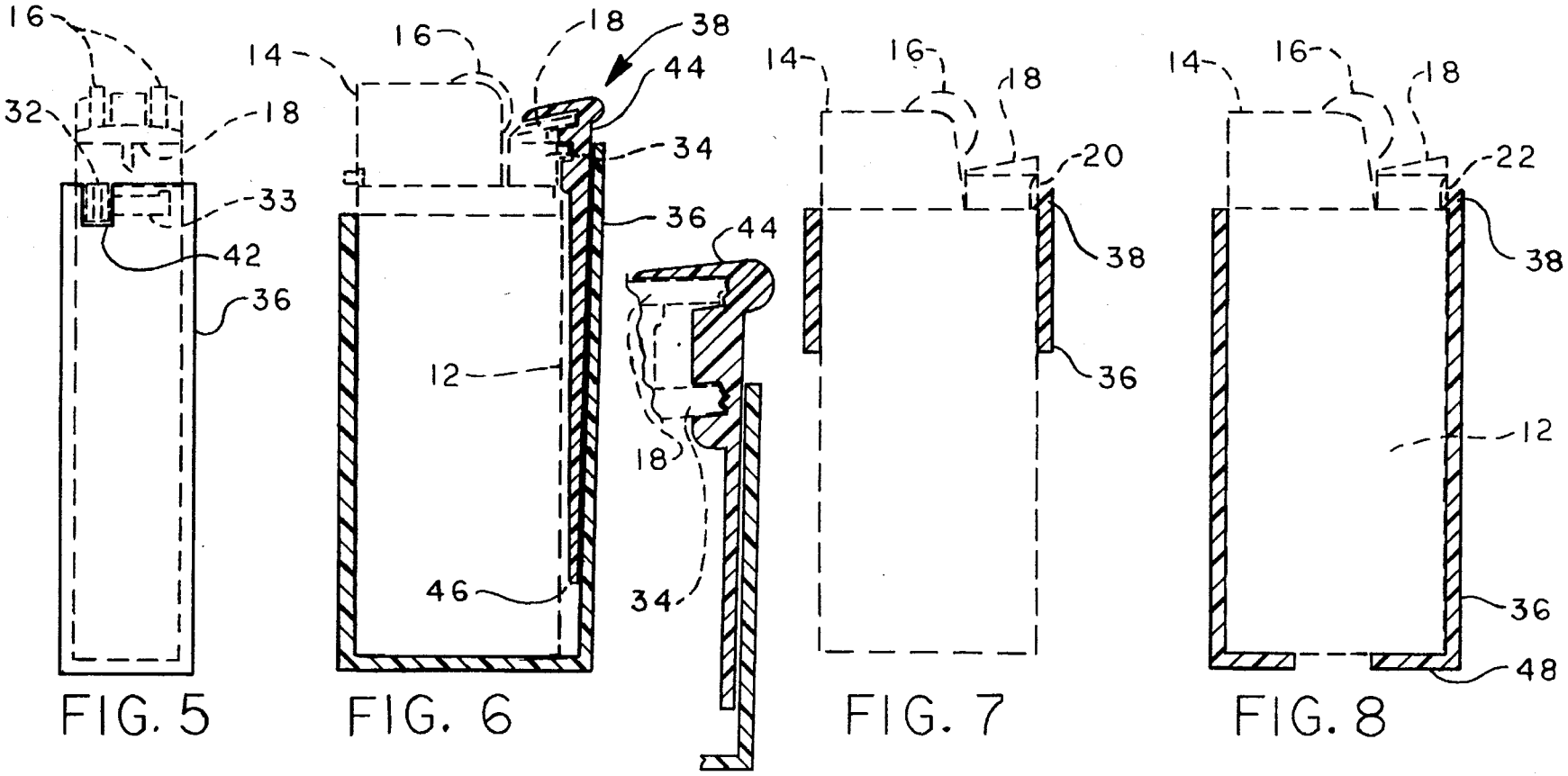
FIG. 6 is a cross-sectional view through the center of an alternative embodiment of the invention installed on a disposable lighter shown in phantom, with the lighter having the child-resistant feature of FIG. 1D which is overridden in the practice of the invention.
FIG. 6A is a cut away view of the laterally extending projection of the apparatus of the invention portrayed in FIG. 6.
FIG. 7 and FIG. 8 are cross-sectional views through the center of alternative embodiments of the invention showing that the apparatus of the invention need not completely encase the lower portion of the lighter.

The apparatus and method of the present invention serve to disengage the child-resistant mechanism on conventional disposable lighters. The child-resistant mechanisms addressed by the practice of the present invention as well as the invention itself will be best understood by referring to the attached drawings, wherein the same part is identified throughout by the same reference number. FIGS. 1A–1D illustrate various modifications to conventional lighters made to achieve "child-resistance", while FIGS. 2A–2C, 3–3A, 4–6 and 6A illustrate how the child-resistant mechanism of the disposable lighters portrayed in FIGS. 1A–1D are overridden in the practice of the invention. Finally, FIGS. 7–8 illustrate alternate embodiments of the invention. Each of these figures is described below.

Figures 1A, 1B, 1C, 1D:
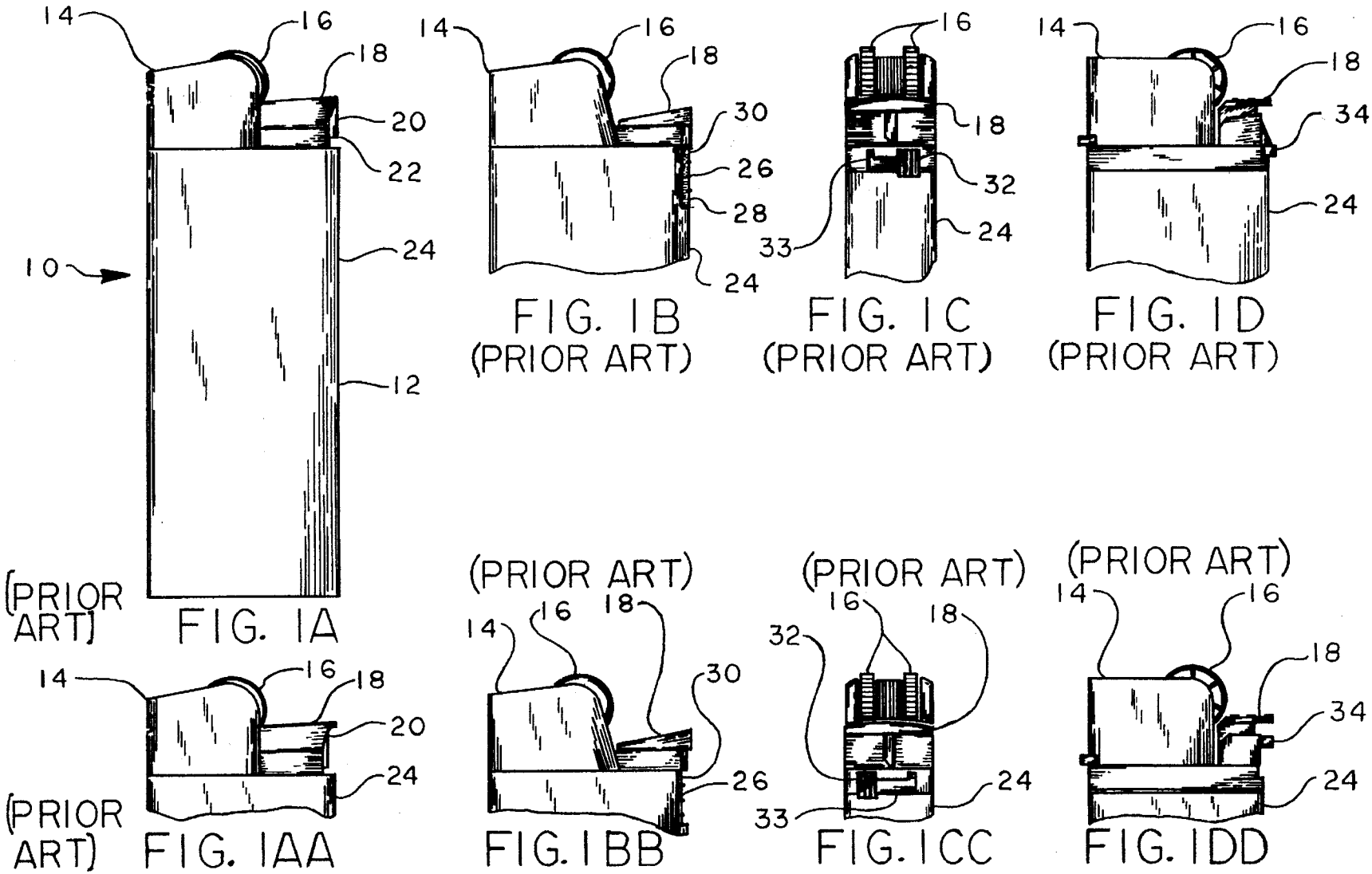
FIG. 1A (PRIOR ART)
FIG. 1AA (PRIOR ART)
FIG. 1B (PRIOR ART)
FIG. 1BB (PRIOR ART)
FIG. 1C (PRIOR ART)
FIG. 1CC (PRIOR ART)
FIG. 1D (PRIOR ART)
FIG. 1DD (PRIOR ART)
FIG. 1A is a side view of a disposable lighter showing the child-resistant feature of a lighter in the form of a button which must be pushed into the lighter body to disengage the locking mechanism on the thumb lever.
FIG. 1B is a cut-away side view of the top portion of a disposable lighter showing the child-resistant feature of a lighter in the form of a button which must be both pushed in and up to disengage the locking mechanism on the thumb lever.
FIG. 1C is a cut-away front view of the top portion of a disposable lighter showing the child-resistant feature of a lighter in the form of a lever which must be pushed left (across the side of the lighter) and up to disengage the locking mechanism on the thumb lever.
FIG. 1D is a cut-away side view of the top portion of a disposable lighter showing the child-resistant feature of a lighter in the form of a lock lever which must be pushed in and up to disengage the locking mechanism on the thumb lever.

Typical disposable lighters benefited in the practice of the invention are illustrated in FIGS. 1A–1D and, aside from their various child-resistant features, are of a commonly known design. Referring to FIG. 1A, a disposable lighter 10 has a lighter body 12, a flame support 14, a friction wheel 16, and a depressible actuating means 18, also termed a thumb lever. The lighter body 10 houses a fuel tank (not shown) which supplies fuel to a gas fuel valve (not shown) that is operationally connected to the thumb lever 18. The depression of the thumb lever 18 operates to release fuel from the fuel tank into the region of the flame support 14, while the friction wheel operates to supply a spark in the region of the flame support 14 that readily ignites the released fuel. Thus, the lighter 10 is typically operated by rotating the friction wheel 16 and depressing the thumb lever 18 in a single downward motion of one's thumb, thereby causing a spark generated by the friction wheel 16 to ignite fuel released by the depression of the thumb lever 18.

The manufacturers of disposable lighters have incorporated locking mechanisms into disposable lighters 10 that render lighters child-resistant by restricting the depression of the thumb lever 18, thereby preventing the release of fuel and, consequently, the production of a flame. To operate a child-resistant disposable lighter, one must perform a particular sequence of steps to disengage the locking mechanism before performing the familiar downward thumb motion to produce a flame. Mastering the sequence of steps required to disengage the locking mechanism is a challenge to young children, thereby rendering such disposable lighters "child-resistant". The locking mechanism automatically re-engages once the thumb lever has been depressed, so that the sequence of steps required to disengage the locking mechanism must be performed prior to each attempt to produce a flame.

While manufacturers of lighters 10 have universally employed a locking mechanism preventing the depression of the thumb lever 18 to provide the necessary level of child-resistance, the locking mechanism itself and, accordingly, the particular sequence of steps required to disengage the locking mechanism vary. FIG. 1A–1D illustrate four variations on the locking mechanism, which will now be described.

The locking mechanism typified by FIG 1A consists of a button 20 situated immediately below the thumb lever 18 and having a lip 22. In its locked position, the lip 22 of the button 20 rests atop the casing 24 of the lighter body. As such, pressure applied to the thumb lever 18 simply serves to pressure the lip 22 against the casing 24, thereby restricting the downward motion available to the thumb lever 18. In order to disengage this type of locking mechanism, one must move the button 20 to its unlocked position by pushing the button 20 inward toward the interior of the lighter body 10, or more specifically, by pushing the button 20 toward the flame support 14. Thus, one disengages this type of locking mechanism essentially by moving the lip 22 into the confines of the lighter body 12 so that button 20 may slide inside the lighter body 12, thereby allowing the thumb lever 18 its full downward path to release fuel into the region of the flame support 14. FIG. 1AA illustrates button 20 in its unlocked position. This type of locking mechanism is found, for example, in Cricket® disposable lighters and Poppell® disposable lighters, manufactured respectively by Cricket U.S.A. and B.V. Poppell Netherlands.

The locking mechanism typified by FIG. 1B consists of a button 26 having a series of ridges 28, with the button 26 being situated immediately below the thumb lever 18. In its locked position, the button 26 assumes the upright position portrayed in FIG. 1B, thereby serving as a barrier in the path of the thumb lever 18 and accordingly restricting the depression of the thumb lever 18. In order to disengage this type of locking mechanism, one must move the button 26 so that its top portion 30 slides inside the confines of the lighter body 12 and out of the path of the thumb lever 18. This is accomplished by pushing the button 26 toward the interior of the lighter body and then pushing the button 26 upward toward the thumb lever 18. The ridges 28 of button 26 provide a manner of engaging the button 26 by one's fingernail so that one can push the button 26 in an upward fashion. FIG. 1BB illustrates button 26 in its unlocked position. This type of locking mechanism is employed by, for example, the Bic Corporation which manufactures disposable Bic® lighters.

The type of locking mechanism typified by FIG. 1C consists of a lever 32, rather than a button. However, like the configurations presented in FIG. 1A and 1B, this type of locking mechanism restricts the downward motion achievable by the thumb lever 18 by placing a barrier in the path of the thumb lever 18. Here, the lever 32 is mechanically connected to a barrier (not shown) situated underneath the thumb lever 18. In its locked position, the lever 32 is situated to one side of a horizontal path 33 and the barrier to which it is connected blocks .the downward path of the thumb lever 18. In order to disengage this type of locking mechanism, one must move the lever 32 across to the opposite side of its horizontal path 33 and upward, as illustrated in FIG. 1CC. By so moving the lever 32, the barrier is moved out of the path of the thumb lever 18, which may therefore be depressed to allow the release of fuel for purposes of producing a flame. This type of locking mechanism is employed by, for example, Calico Brands in their disposable SAF-T-LOC™ lighters.

Finally, the type of locking mechanism typified by FIG. 1D consists of a lock lever 34 which controls the position of a resilient leaf (not shown) situated immediately below the thumb lever 18. In its locked position, the resilient leaf blocks any downward motion of the thumb lever 18 (see Kenjiro et al, U.S. Pat. No. 5,368,473 for further explanation). In order to disengage this type of locking mechanism, one must engage the lock lever 34 to move the resilient leaf out of the path of the thumb lever 18. This is accomplished by pushing the lock lever 34 inward toward the interior of the lighter body and then upward toward the thumb lever 18. FIG. 1DD illustrates the lock lever 34 in its unlocked position. This type of locking mechanism is employed by, for example, the Scripto-Tokai Corporation, which manufactures disposable Scripto® lighters.

Having described methods commonly employed to prevent the depression of the thumb lever for purposes of rendering disposable lighters child-resistant, the present apparatus and method devised to override these child-resistant mechanisms are described. FIGS. 2A–6 illustrate the various embodiments employed in the practice of the invention, all of which share certain common features. Turning to FIG. 2A, a perspective view of the preferred embodiment employed in the practice of the invention is portrayed. In this embodiment, the invention comprises a sleeve or jacket 36 that is adapted to be slipped onto the lighter body 12 of a disposable lighter such as portrayed by FIG. 1A. The sleeve 36 is formed having a laterally extending projection 38 adapted to engage the locking mechanisms (20, 26, 32, and 34) of disposable lighters so that the locking mechanisms are disengaged and the thumb lever 18 may be depressed. (Alternatively, the sleeve 36 may instead be provided with a slot 42 to engage the locking mechanism 32 as shown in FIG. 5.) The sleeve 36 is provided with slits 40 along the sides of the laterally extending projection 38 to allow the laterally extending projection more flexibility to bend during installation of the sleeve 36 onto a lighter 10. FIG. 2B illustrates how the laterally extending projection 38 protrudes into the confines of the sleeve 36. While the shape of the laterally extending projection 38 is varied to accommodate the various types of buttons and levers found in child-resistant features of disposable lighters, the various embodiments of the present apparatus share a single inventive feature: a laterally extending projection 38 (or slot 42) is positioned to engage the locking mechanism of a child-resistant disposable lighter 10 to override the child-resistant mechanism and allow the lighter 10 to be operated as if no child-resistant features were present.

Figure 2C:
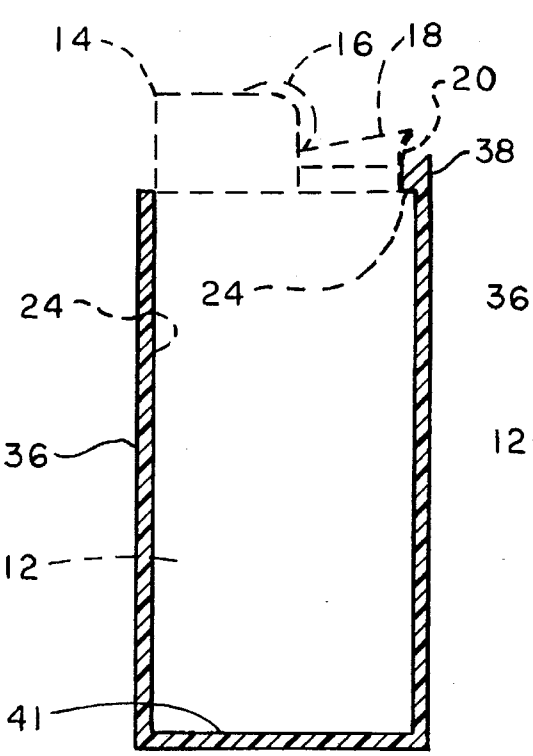
FIG. 2C is a cross-sectional view through the center of the preferred embodiment of the invention installed on a disposable lighter shown in phantom, with the lighter having the child-resistant feature of FIG. 1A.
Figure 2A:
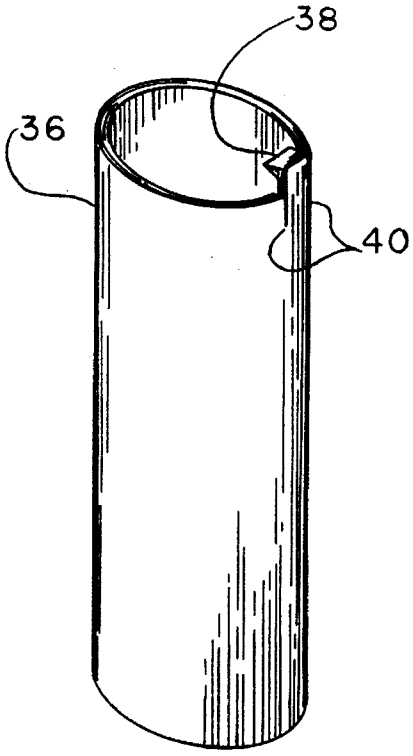
FIG. 2A is a perspective view of the preferred embodiment of the invention standing alone, without being installed on a disposable lighter, with this embodiment serving to override the child-resistant feature illustrated in FIG. 1A.
Figure 2B:
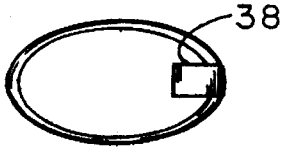
FIG. 2B is a top view of the invention embodied in FIG. 2A standing alone, without being installed on a disposable lighter.

Turning now to FIGS. 2C and 3–6, illustrations are provided which demonstrate how the apparatus of the invention overrides the child-resistant features portrayed in FIGS. 1A–1D. FIG. 2C is a cross-sectional view through the side of the apparatus of the invention portrayed in FIG. 2A as it is installed on the disposable lighter 10 of FIG. 1A, shown in phantom. To install the apparatus of the invention, the lighter body 12 is inserted into the sleeve 36 until the bottom 41 of the lighter meets the end of the sleeve, thereby aligning the laterally extending projection 38 with the button 20. The laterally extending projection 38 is in the shape of a ramp that protrudes toward the button 20 and is aligned such that the ramp rests atop the casing 24 while pushing the button 20 inward, thereby moving the button 20 to its unlocked position as the thumb lever 18 is depressed along its full downward path. Thus, the apparatus of the invention renders the child-resistant mechanism disengaged as portrayed in FIG. 1AA. The locking mechanism can be so disengaged so long as the apparatus of the invention remains in place; accordingly, the lighter 10 may be operated as if there were no child-resistant features in place.

Figure 3:
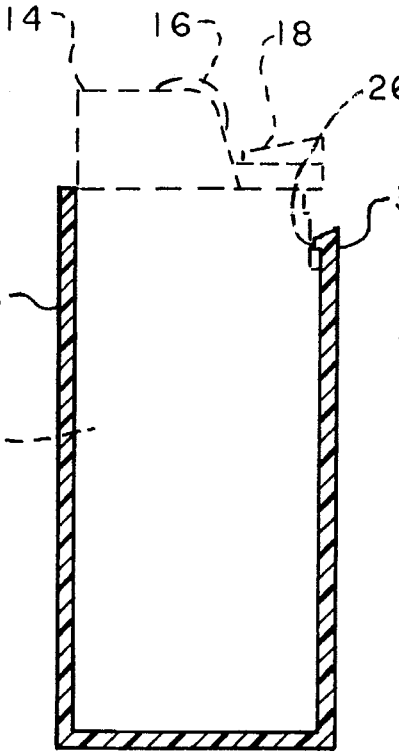
FIG. 3 is a cross-sectional view through the center of an alternative embodiment of the invention installed on a disposable lighter shown in phantom, with the lighter having the child-resistant feature of FIG. 1B which is overridden in the practice of the invention.
Figure 3A:
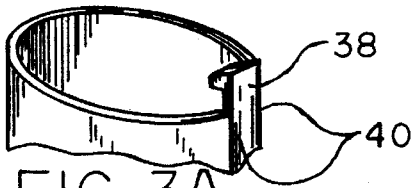
FIG. 3A is a cut away view of the laterally extending projection of the apparatus of the invention portrayed in FIG. 3.

FIG. 3 is a cross-sectional view through the side of the apparatus of the invention as it is installed on the disposable lighter 10 portrayed in FIG. 1B, shown in phantom. The apparatus of the invention is installed as described above, so that the laterally extending projection 38 is aligned with the button 26. In this embodiment, the laterally extending projection 38 is in the shape of a cam, which is illustrated in FIG. 3A. The cam 38 serves to engage the button 26 as the sleeve 36 is installed, thereby pushing the button 26 inward toward the interior of the lighter body 12. Thus, the apparatus of the invention disengages the child-resistant mechanism of the lighter 10 as portrayed in FIG. 1BB so that the thumb lever 18 may be depressed along its full downward path at will.

Figure 4:
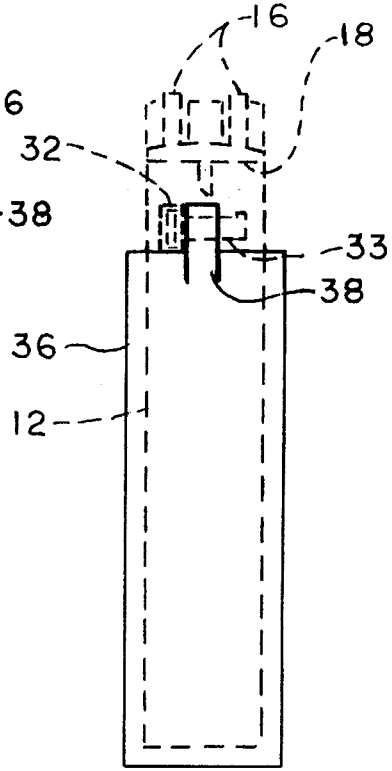
FIG. 4 and FIG. 5 are front views of two distinct alternative embodiments of the invention installed on a disposable lighter, with the lighter having the child-resistant feature of FIG. 1C which is in the unlocked position and prevented from returning to the locked position in the practice of the invention.

FIG. 4 is a cross-sectional view through the front of the apparatus of the invention as it is installed on the disposable lighter 10 portrayed in FIG. 1C, shown in phantom. Here, the lever 32 of the locking mechanism must first be placed in its unlocked position before the apparatus of the invention is installed in the manner described above. In this embodiment, the laterally extending projection 38 may assume the shape of a cam, with its sole function being to prevent the lever 32 from returning to the locked position illustrated in FIG. 1C, which the cam achieves by simply blocking the horizontal path 33 taken by the lever 32 to return to its locked position. Thus, the apparatus of the invention retains the child-resistant mechanism of the lighter 10 in the unlocked position portrayed in FIG. 1CC so that the thumb lever 18 may be depressed along its full downward path to release fuel used to produce a flame.

FIG. 5 is a cross-sectional view through the front of an alternative embodiment of the apparatus of the invention as it is installed on the disposable lighter 10 portrayed in FIG. 1C, shown in phantom. As in the embodiment portrayed in FIG. 4, the lever 32 of the locking mechanism must first be placed in its unlocked position before the apparatus of the invention is installed in the manner described above. In this alternative embodiment, a slot 42 formed in the sleeve 36 partially surrounds the lever 32 and holds the lever 32 in the unlocked position. Thus, this alternative embodiment retains the child-resistant mechanism of the lighter 10 in the unlocked position portrayed in FIG. 1CC so that the thumb lever 18 may be depressed along its full downward path.

FIG. 6 is a cross-sectional view through the from of the apparatus of the invention as it is installed on the disposable lighter 10 portrayed in FIG. 1D, shown in phantom. The laterally extending projection 38 is more elaborate that in the foregoing embodiments, since the child-resistant features portrayed in FIG. 1D require that the thumb lever 18 and the lock lever 34 be "locked" together. Thus, a piston 44 is employed which travels within a slot 46 between the sleeve 36 and the lighter body 12. FIG. 6A illustrates the piston 44 in greater detail. To install the present embodiment, the lock lever 34 is first placed in its unlocked position. The apparatus of the invention is then installed by inserting the lighter body 12 into the sleeve 36, whereupon the piston 44 is situated so that it grasps both the thumb lever 18 and the lock lever 34. As such, the lock lever 34 remains in its unlocked position as illustrated in FIG. 1DD so long as the apparatus of the invention remains installed. During operation of the lighter 10 as contained within this embodiment of the invention, the piston 44 travels up and down in the slot 46 with the movement of the thumb lever 18.

FIGS. 7 and 8 portray alternative embodiments of the sleeve 36 that may be employed in the practice of the invention. The apparatus of the invention need not comprise an all-enclosing sleeve such as portrayed in FIGS. 2–6. Rather than fitting the body of the lighter 10, the embodiment of FIG. 7 only partially covers the body of the lighter 10, whereas the embodiment of FIG. 8 leaves an opening at the bottom of the sleeve 36. While a sleeve 36 having a bottom portion 48 serves to register the alignment of the sleeve 36 and the lighter body 12 so that the laterally extending projection 38 (or slot 42) is properly and stably positioned, other means of aligning the laterally extending projection 38 may be employed. For example, a sleeve 36 such as portrayed in FIG. 7 may be installed by pushing it into place over the top of the lighter body 12 rather than by inserting the lighter body 10 into a full sleeve or it may be manufactured from a suitably elastic material so as to resist dislocation once installed on the lighter body 10. Also, projections (other than the laterally extending projection 38) may be incorporated into the sleeve 36 which engage certain features of the lighter body such as openings or indentations, thereby achieving a stable alignment of the apparatus. The novelty of the present invention is not based upon the shape of the sleeve body but rather upon the provision of a laterally extending projection 38 (or slot 42) which serves to disengage the locking mechanism of child-resistant lighters. Thus, the "sleeve" feature of the invention may be more generally referred to as a "band" that serves to align and stabilize the laterally extending projection 38 (or slot 42) with the locking mechanism to be disengaged.

The materials which may be suitably employed to fabricate the apparatus of the present invention must exhibit sufficient hardness to maintain the shape of the apparatus while having sufficient flexibility to allow the laterally extending projection 38 to bend as the apparatus is installed. Plastic materials are preferably employed in the practice of the invention with thermoplastic materials being most preferred. Accordingly, the preferred method of manufacture of the apparatus of the invention is by plastic injection molding, although the invention is not so limited. Examples of thermoplastic materials suitably employed in the practice of the invention include acrylic-styrene-acrylonitrile (ASA), styrene-acrylonitrile (SAN), polyvinyl chlorides, polycarbonates, polyamides, polyesters, polyetherimides, polysulfones, polyethersulfones, polyethylene oxides, methylmethacrylates, polyethylenes, polyurethanes, polypropylenes and thermoplastic elastomers (TPE). It is conceivable that metals might be incorporated into the sleeve or band 36 of the present apparatus or that the sleeve 36 might be sheathed in metal, perhaps for decorative purposes.

The apparatus and method of the invention provide a low-cost, easily implemented, reversible, and non-intrusive manner in which to override the child-resistant mechanisms incorporated into disposable lighters. The present invention enables those adults who use disposable lighters outside of the presence of children to bypass the sequence of steps normally required to operate commercially-available lighters having child-resistant features. For adults who are physically unable to perform the sequence of steps necessary to operate child-resistant lighters, the apparatus of the present invention restores to them the option of using disposable lighters. While the band is a removable device that may be re-used, it will likely be considered disposable because of its low purchase price.

Thus, there has been disclosed an apparatus and a method for overriding the child-resistant features of disposable lighters. It will be readily apparent to those skilled in this art that various changes and modifications of an obvious nature may be made, and all such changes and modifications may be made without departing from the scope of the invention, as defined by the appended claims.

What is claimed is:

1. An apparatus to override a child-resistant mechanism on a cigarette lighter, said cigarette lighter comprising a lighter body containing a fuel tank and a flame support with a fuel valve therebetween that is linked in operational relationship to a depressible actuating means which, upon being depressed, allows fuel to flow to said flame support where it may be ignited and burned, said child-resistant mechanism comprising a lock means, said lock means being movable between a locked position, in which it is situated below at least a portion of said depressible actuating means so that depression of said depressible actuating means is prevented, and an unlocked position, in which said lock means is spaced from the path of motion assumed by said depressible actuating means upon being depressed, thereby allowing depression of said depressible actuating means, said apparatus comprising a band that slidably engages said lighter body, said band having a laterally extending projection, whereupon said laterally extending projection engages said lock means such that said lock means is moved to its unlocked position, thereby allowing said depressible actuating means to be depressed and overriding said child-resistant mechanism of said cigarette lighter.

2. The apparatus of claim 1 wherein said band comprises a sleeve that completely surrounds and encases the body of said cigarette lighter, the top of said sleeve defining an opening exposing said flame support and said depressible actuating means.

3. The apparatus of claim 1 wherein said laterally extending projection comprises a ramp and said lock means comprises a button that is placed in said unlocked position upon being depressed toward the interior of said lighter body by said ramp.

4. The apparatus of claim 1 wherein said laterally extending projection comprises a cam and said lock means comprises a button that is placed in said unlocked position by said cam, said cam depressing said button toward the interior of said lighter body.

5. The apparatus of claim 1 wherein said laterally extending projection comprises a cam and said lock means comprises a lever that is placed in said unlocked position by sliding said lever horizontally across said lighter body then upward toward said depressible actuating means, said cam serving to maintain said lever in said unlocked position by preventing said lever from returning to its locked position.

6. The apparatus of claim 1 wherein said laterally extending projection comprises a piston member and said lock means comprises a lock lever that is maintained in said unlocked position by said piston member, said piston member simultaneously engaging said depressible actuating means and said lock lever.

7. The apparatus of claim 1 wherein said band comprises a material selected from the group consisting of acrylic-styrene-acrylonitrile, styrene-acrylonitrile, polyvinyl chlorides, polycarbonates, polyamides, polyesters, polyetherimides, polysulfones, polyethersulfones, polyethylene oxides, methylmethacrylates, polyethylenes, polyurethanes, polypropylenes and thermoplastic elastomers.

8. The apparatus of claim 7 wherein said band further comprises a metal.

9. An apparatus to override a child-resistant mechanism on a cigarette lighter, said cigarette lighter comprising a lighter body containing a fuel tank and a flame support with a fuel valve therebetween that is linked in operational relationship to a depressible actuating means which, upon being depressed, allows fuel to flow to said flame support where it may be ignited and burned, said child-resistant mechanism comprising a lock means, said lock means being movable between a locked position, in which it is situated below at least a portion of said depressible actuating means so that depression of said depressible actuating means is prevented, and an unlocked position, in which said lock means is spaced from the path of motion assumed by said depressible actuating means upon being depressed, thereby allowing depression of said depressible actuating means, said apparatus comprising a band that slidably engages said lighter body, said band defining a slot, whereupon said slot engages said lock means such that said lock means remains in its unlocked position, thereby allowing said depressible actuating means to be depressed and overriding said child-resistant mechanism of said cigarette lighter.

10. An apparatus to override a child-resistant mechanism on a cigarette lighter, said cigarette lighter comprising a lighter body containing a fuel tank and a flame support with a fuel valve therebetween that is linked in operational relationship to a depressible actuating means which, upon being depressed, allows fuel to flow to said flame support where it may be ignited and burned, said child-resistant mechanism comprising a lock means, said lock means being movable between a locked position, in which it is situated below at least a portion of said depressible actuating means so that depression of said depressible actuating means is prevented, and an unlocked position, in which said lock means is spaced from the path of motion assumed by said depressible actuating means upon being depressed, thereby allowing depression of said depressible actuating means, said apparatus comprising a sleeve that slidably engages said lighter body such that said lighter body below said flame support is encased, said sleeve having a laterally extending projection selected from the group consisting of a cam and a ramp, whereupon said laterally extending projection engages said lock means such that said lock means is moved to its unlocked position, thereby allowing said depressible actuating means to be depressed and overriding said child-resistant mechanism of said cigarette lighter.

11. A method to override a child-resistant mechanism on a cigarette lighter, said cigarette lighter comprising a lighter body containing a fuel tank and a flame support with a fuel valve therebetween that is linked in operational relationship to a depressible actuating means which, upon being depressed, allows fuel to flow to said flame support where it may be ignited and burned, said child-resistant mechanism comprising a lock means, said lock means being movable between a locked position, in which it is situated below at least a portion of said depressible actuating means so that depression of said depressible actuating means is prevented, and an unlocked position, in which said lock means is spaced from the path of motion assumed by said depressible actuating means upon being depressed, thereby allowing depression of said depressible actuating means, said method comprising:

(a) providing a band having a laterally extending projection; and (b) slidably engaging said lighter body with said band, whereupon said laterally extending projection engages said lock means such that said lock means is moved to its unlocked position.

12. The method of claim 11 wherein said band comprises a sleeve that completely surrounds and encases the body of said cigarette lighter, the top of said sleeve defining an opening exposing said flame support and said depressible actuating means.

13. The method of claim 11 wherein said laterally extending projection comprises a ramp and said lock means comprises a button that is placed in said unlocked position upon being depressed toward the interior of said lighter body by said ramp.

14. The method of claim 11 wherein said laterally extending projection comprises a cam and said lock means comprises a button that is placed in said unlocked position by said cam, said cam depressing said button toward the interior of said lighter body.

15. The method of claim 11 wherein said laterally extending projection comprises a cam and said lock means comprises a lever that is placed in said unlocked position by sliding said lever horizontally across said lighter body then upward toward said depressible actuating means, said cam serving to maintain said lever in said unlocked position by preventing said lever from returning to its locked position.

16. The method of claim 11 wherein said laterally extending projection comprises a piston member and said lock means comprises a lock lever that is maintained in said unlocked position by said piston member, said piston member simultaneously engaging said depressible actuating means and said lock lever.

17. The method of claim 11 wherein said band comprises a material selected from the group consisting of acrylic-styrene-acrylonitrile, styrene-acrylonitrile, polyvinyl chlorides, polycarbonates, polyamides, polyesters, polyetherimides, polysulfones, polyethersulfones, polyethylene oxides, methylmethacrylates, polyethylenes, polyurethanes, polypropylenes and thermoplastic elastomers.

18. The method of claim 17 wherein said band further comprises a metal.

19. A method to override a child-resistant mechanism on a cigarette lighter, said cigarette lighter comprising a lighter body containing a fuel tank and a flame support with a fuel valve therebetween that is linked in operational relationship to a depressible actuating means which, upon being depressed, allows fuel to flow to said flame support where it may be ignited and burned, said child-resistant mechanism comprising a lock means, said lock means being movable between a locked position, in which it is situated below at least a portion of said depressible actuating means so that depression of said depressible actuating means is prevented, and an unlocked position, in which said lock means is spaced from the path of motion assumed by said depressible actuating means upon being depressed, thereby allowing depression of said depressible actuating means, said method comprising:

(a) providing a band defining a slot; and (b) slidably engaging said lighter body with said band, whereupon said slot engages said lock means such that said lock means is maintained in its unlocked position.

20. A method to override a child-resistant mechanism on a cigarette lighter, said cigarette lighter comprising a lighter body containing a fuel tank and a flame support with a fuel valve therebetween that is linked in operational relationship to a depressible actuating means which, upon being depressed, allows fuel to flow to said flame support where it may be ignited and burned, said child-resistant mechanism comprising a lock means, said lock means being movable between a locked position, in which it is situated below at least a portion of said depressible actuating means so that depression of said depressible actuating means is prevented, and an unlocked position, in which said lock means is spaced from the path of motion assumed by said depressible actuating means upon being depressed, thereby allowing depression of said depressible actuating means, said method comprising:

(a) providing a sleeve having a laterally extending projection selected from the group consisting of a cam and a ramp; and (b) slidably engaging said lighter body with said sleeve, thereby encasing said lighter body below said flame support, whereupon said laterally extending projection engages said lock means such that said lock means is moved to its unlocked position.

* * * * *